US010526100B2

(12) United States Patent
Schuette

(10) Patent No.: US 10,526,100 B2
(45) Date of Patent: Jan. 7, 2020

(54) APPARATUS AND METHOD FOR PROCESSING STACKS OF OPEN-MOUTH BAGS

(71) Applicant: Volker Schuette, Oelde (DE)

(72) Inventor: Volker Schuette, Oelde (DE)

(73) Assignee: HAVER & BOECKER OHG, Oelde (DE)

( * ) Notice: Subject to any disclaimer, the term of this patent is extended or adjusted under 35 U.S.C. 154(b) by 689 days.

(21) Appl. No.: 14/345,972

(22) PCT Filed: Sep. 24, 2012

(86) PCT No.: PCT/EP2012/003989
§ 371 (c)(1),
(2) Date: Mar. 20, 2014

(87) PCT Pub. No.: WO2013/041243
PCT Pub. Date: Mar. 28, 2013

(65) Prior Publication Data

US 2014/0223859 A1 Aug. 14, 2014

(30) Foreign Application Priority Data

Sep. 22, 2011 (DE) ..... 10 2011 113 879

(51) Int. Cl.
*B65B 43/16* (2006.01)
*B65B 43/18* (2006.01)
*B65B 61/02* (2006.01)

(52) U.S. Cl.
CPC ..... *B65B 43/16* (2013.01); *B65B 43/18* (2013.01); *B65B 61/025* (2013.01)

(58) Field of Classification Search
CPC ..... B65B 61/025; B65H 3/0623
USPC ..... 53/131.2, 131.4, 381.1, 384.1, 385.1, 53/386.1, 468, 492; 221/311; 493/320
See application file for complete search history.

(56) References Cited

U.S. PATENT DOCUMENTS 3,190,054 A * 6/1965 Arnold ..... B41F 17/00 101/41
3,358,414 A * 12/1967 Hersh ..... B65B 61/025 101/334
3,566,578 A 3/1971 Thorne
(Continued)

FOREIGN PATENT DOCUMENTS

DE 2 342 731 3/1974
FR 2 662 420 11/1991
(Continued)

*Primary Examiner* — Gloria R Weeks
*Assistant Examiner* — Patrick B Fry
(74) *Attorney, Agent, or Firm* — Greer, Burns & Crain, Ltd.

(57) ABSTRACT

A processing device and method for processing a stack of bags having a multitude of open-mouth bags are provided, including a stacking device on which the stack of bags can be disposed in a base position, wherein the open-mouth bags of the stack have a bag length and an open filling mouth at one end. A marker device and a bag conveying device are provided that are suitable and provided for gripping the topmost open-mouth bag of the stack in the base position and displacing it to a take-up position that is only partially supported on the stack of bags and putting at least one mark on the open-mouth bags in the take-up position.

10 Claims, 10 Drawing Sheets

(56) References Cited

U.S. PATENT DOCUMENTS

| | | | | | |
|---|---|---|---|---|---|
| 3,765,326 | A * | 10/1973 | Hawkins | B41F 17/00 | 101/11 |
| 3,823,664 | A * | 7/1974 | Shenoha | B41F 17/006 | 101/41 |
| 3,878,776 | A * | 4/1975 | Schneider | B41F 17/24 | 101/27 |
| 3,881,410 | A * | 5/1975 | Shenoha | B41F 17/006 | 101/297 |
| 3,945,173 | A | 3/1976 | Buzzi | | |
| 4,073,117 | A * | 2/1978 | Shenoha | B65B 61/025 | 101/44 |
| 4,073,122 | A * | 2/1978 | Areson | B41F 17/24 | 101/44 |
| 4,970,847 | A | 11/1990 | Gradwohl | | |
| 6,308,501 | B1 * | 10/2001 | Brinkman | B65B 5/045 | 53/370.6 |
| 6,920,736 | B2 * | 7/2005 | Miyazaki | B65B 61/26 | 53/131.4 |
| 7,559,548 | B2 * | 7/2009 | Dobrindt | B65H 1/04 | 271/171 |
| 2009/0241475 | A1 * | 10/2009 | Tsutsui | B65B 61/186 | 53/459 |
| 2011/0138751 | A1 * | 6/2011 | Nakagawa | B65B 43/50 | 53/469 |

FOREIGN PATENT DOCUMENTS

| | | | | |
|---|---|---|---|---|
| GB | 2027665 A * | 2/1980 | B65B 43/18 | |
| NL | 1035060 | 8/2009 | | |
| WO | 2011/093729 | 8/2011 | | |

* cited by examiner

APPARATUS AND METHOD FOR PROCESSING STACKS OF OPEN-MOUTH BAGS

BACKGROUND

The present invention relates to an apparatus and a method for processing stacks of bags and in particular a packaging machine or an apparatus or a device assigned to a packaging machine. The apparatus may serve to separate the bags of a stack of bags. The apparatus may furthermore also open the separated bags, append them to a filling spout, and optionally fill the bags with bulk material, close them and convey them off.

A great variety of processing apparatuses for open-mouth bags have been disclosed in the prior art. Thus there are for example packaging machines referred to as Form-Fill-Seal machines (FFS packaging machines) which manufactures the bags required from a tube stock on the machine which are subsequently filled in the machine. There are also packaging machines where stacks of prefabricated open-mouth bags are fed to the packaging machine. In these packaging machines for filling prefabricated open-mouth bags the bags must first be separated from the stack of bags before an open-mouth bag can be appended to the filling spout of the packaging machine, and filled.

Various apparatuses and devices for separating open-mouth bags from a stack of bags have been disclosed. For example AT 404 117 B discloses a device for feeding a separated open-mouth bag. A stack of open-mouth bags is stocked in a magazine. The suction heads of an unloading device grip and lift the closed bag bottom of the topmost open-mouth bag. The bag hangs downwardly off the suction heads and with its open end is still supported on the stack of bags. Thereafter a chain grate travelling around the magazine over diverting rollers is driven and displaced beneath the lifted bag such that the entire bag is lifted and placed on the grate area of the chain grate. The open-mouth bag is thus separated and, due to the chain grate rotating further, it can be transferred to an adjacent conveying device comprising multiple rotating belts. The conveying device transfers the separated open-mouth bag to another conveying device positioned downstream which during the further movement opens the bag and transfers it to a placement device which appends the opened open-mouth bag to a filling spout.

This prior art operates basically satisfactorily. By means of a chain grate traveling beneath an open-mouth bag that is lifted by its bottom end and is subsequently transferred to a conveying device and thereafter to another conveying device, a dependable separation of open-mouth bags from a stack of bags can be achieved.

The drawback of the known system is the high space requirement since the magazine with the chain grate traveling around the magazine, the conveying device and the further conveying device and the downstream placement device are all large and are furthermore positioned in line and thus require considerable space.

SUMMARY

It is therefore the object of the present invention to provide a processing device and a method for processing stacks of open-mouth bags which require less floor space given a comparable output.

A processing device according to the invention serves to process at least one stack of bags comprising a plurality of open-mouth bags. At least one stacking device is provided on which the stack of bags can be placed in a base position. The stacked open-mouth bags have a specified bag length and an open filling mouth at one of its ends.

The other of the ends may be provided to be a closed bag bottom. It is also possible to form the closed bag bottom at a later time such that the stack of bags consists of bags having open mouths at both ends. At least one bag conveying device is provided that is suitable and provided for gripping the topmost open-mouth bag off the stack of bags in its base position and to displace it to a take-up position that is partially offset on the stack of bags.

A marker device for marking the open-mouth bags is preferably provided that is suitable and fitted for putting at least one mark on the open-mouth bags in the take-up position. Such mark may for example include the bagging date or the batch number or the like.

The processing device according to the invention has many advantages since it allows a compact device that enables high capacity and output while requiring little space.

The open-mouth bag is efficiently separated in that the bag lying topmost on the stack of bags is gripped and positioned offset on the stack wherein the distance of the take-up position from the base position is shorter than the bag length. Grippers or the like can grip the end of the open-mouth bag protruding beyond the edge of the stack of bags for transferring the open-mouth bag to other components of the processing device.

The floor space required for separating and the necessary mounting space are only slightly larger than the stack of bags. Since the length of travel is short the processing device can operate with high efficiency. Surprisingly it has been found that the output can be considerably increased over the bag separator of the prior art although considerably less mounting space is required.

Preferably the bag conveying device grips the topmost open-mouth bag by its open filling mouth. The bag conveying device in particular displaces the topmost open-mouth bag in that the bag conveying device seizes the topmost open-mouth bag by its open filling mouth, pulling it to the take-up position.

This enables a compact structure which allows a readily accessible placement of the marker device. Since the open-mouth bag is pulled forward by its open mouth, the marker device can be disposed in a readily accessible area which also allows ease of maintenance of the marker device.

The marker device allows labeling the open-mouth bags during processing. The marker device can inscribe data including the content, the storage life or the batch of the bagged product on the open-mouth bag immediately prior to filling. This allows unbroken tracking and unbroken evidence on the origin and the batch which is useful and/or necessary with many food products or in manufacturing medical remedies or other substances.

A marker device positioned separately from the processing device requires considerably more space. The presently provided arrangement next to the bag separator requires virtually no additional space. Moreover this position allows a smooth, exact labelling since the open-mouth bag lies flat without any curving. Moreover the open-mouth bag rests precisely on the surface. This is no longer true in the further course of the filling process since the open-mouth bag will hang from the grippers or the filling spout and after filling it does no longer show a flat but rather a curved surface. For this reason these kinds of open-mouth bags tend to be marked these days by way of a separate device downstream of the packaging machine. However, any deposits of product on or wrinkles in the sheet material can impede labeling.

While the bag conveying device grips the topmost open-mouth bag by its open filling mouth, the prior art provides for gripping and lifting an open-mouth bag by its closed bag bottom. In AT 404 117 B it is not possible to grip the bag by its filling mouth since there is the risk that the lower bag wall of the filling mouth will detach from the seized bag wall, falling downwardly wherein the filling mouth is partially generated. Should such a filling mouth be generated even partially only then in this known prior art the rotating chain grate would be placed in front of the opened bag mouth such that the open-mouth bag might be destroyed. At least the bag separator would not operate properly, requiring manual interference by the operator. Therefore in this known prior art the open-mouth bag cannot be gripped by its filling mouth.

Unlike thereto, it is possible and preferred with the present invention to grip the topmost open-mouth bag by its open filling mouth. In case that the bottom layer of the filling mouth should detach from the top layer and should a partially opened filling mouth ensue, then it would close as the open-mouth bag is deposited in its take-up position in an offset position. The separating process would not be impeded thereby.

In advantageous configurations the bag conveying device comprises at least a friction gear device and/or a suction device. Such a suction device may be configured as a sucker or comprise one or more suckers. In particular is the suction device extendably disposed at the bag conveying device. This allows to dispose the bag conveying device to pivot or to be displaced so that in a first position it extends the suction device for gripping the open-mouth bag in the base position. Thereafter the suction device can be retracted and the open-mouth bag can be pulled to the take-up position. There the suction device is in turn extended such that the open-mouth bag is placed on the stacking device in a defined position on a separate support. A drive such as a controlled vacuum cylinder or compressed air cylinder is preferably provided for moving the suction device.

In all the configurations it is preferred for a distance of the take-up position from the base position to be less than half the bag length. Preferably the distance is less than one quarter of the bag length. It is basically sufficient for the distance of the take-up position from the base position to allow the open-mouth bag to be gripped at its filling mouth for conveying the open-mouth bag further. Also the distance is suitable for properly marking the open-mouth bag in the take-up position.

Preferably the bag conveying device is pivotally received at least at one pivot axis that preferably acts on and engages the open filling mouth above the stacking device. A parallelogram-like pivot or some other linear drive of the bag conveying device is possible.

All the configurations are preferably provided with a pivot device that is equipped with at least one gripper device. The pivot device with the gripper device in particular serves for conveying the separated open-mouth bag further. The pivot device with the gripper device can grip the separated open-mouth bag in particular by its filling mouth and transfer it to a partially or entirely hanging position. Such upwardly pivoting of the separated open-mouth bag allows the open-mouth bag to then be opened and appended to a filling spout.

Preferably the gripper device of the pivot device grips in a first pivot position the open end of the open-mouth bag in the take-up position. In a second pivot position the gripper device if preferably suitable for handing the open-mouth bag to a bag opener and/or a bag appending device. The direction of movement of the pivot device from the first pivot position to the second pivot position is preferably opposite the direction of movement of the bag conveying device from the base position to the take-up position. This allows a particularly compact structure. In case that both movements are pivoting motions then both pivot axes are provided in the region of the stacking device. The pivot axes may be provided above and/or beneath the stacking device.

It is also possible to provide a combined device that opens the bags and appends the bag to a filling spout.

The pivot axis of the pivot device is preferably suitable for pivoting the open filling mouth of the open-mouth bag to a handover position. In particular is the pivot axis at the approximate height of the stack of bags. In this way the filling mouth will considerably pivot upwardly with the pivoting motion so as to transfer the open-mouth bag to an at least partially hanging position.

In all the configurations it is preferred to provide at least one marker device for marking the open-mouth bags. At least one mark may be lettering.

It is for example possible to apply the batch number, the bagged product, the filling date, or similar data on the open-mouth bag by means of the marker device. It is possible and preferred to apply at least one mark in the region of the filling mouth. Marking the open-mouth bag in the take-up position has been found to be very advantageous. The output of the processing device according to the invention is not affected thereby at all or to a minor degree only. It is advantageous to provide the marker device beneath the take-up position and to have it inscribe the filling mouth or an area at the filling mouth from beneath with a mark for example in the form of lettering. The marker device may carry out the marking both directly from beneath—e.g. vertical—or else in a more or less horizontal position deflected via a mirror. Deflection via at least one mirror has the advantage that the optical system of the laser employed for marking is protected from dust.

In all the configurations it is particularly preferred to provide a lifting device or at least one lifting device for lifting the bag bottom of the topmost open-mouth bag of the stack of bags in the base position. Furthermore a fixing device is particularly preferably provided for fixing the stack of bags at the bag bottom.

It is particularly advantageous for the lifting device to lift the bag bottom of the topmost open-mouth bag and for a fixing device to fix the stack of bags at the bag bottom beneath the topmost open-mouth bag. By way of fixing the remainder of the stack of bags one can reliably achieve that a transfer of the topmost open-mouth bag from the base position to the take-up position moves only the topmost open-mouth bag. The open-mouth bag lying beneath is reliably prohibited from moving along.

In all the configurations it is possible and preferred to provide at least one product feeder and at least one filling spout for filling the open-mouth bags. It is also possible to position the processing device as a separate device upstream of a filling device and to transfer the separated open-mouth bags to the filling device e.g. already opened.

It is also possible and preferred to provide at least one closing device for closing the open filling mouth of the open-mouth bags after filling. It is also possible to position a discharge device by means of which the filled open-mouth bags are conveyed off.

Preferably a bag stacking magazine is provided from which the stacks of bags are automatically or manually removed as needed and fed to the stacking device.

Preferably the processing device comprises a centering device for positioning and/or centering a stack of bags that is in particular disposed approximately in a base position or precisely in the base position. The bags of the stack of bags in particular show about or even precisely the same dimensions of the bag length and bag width. Preferably at least one centering device is provided that includes at least two centering units disposed opposite one another and which are disposed so they can be moved toward one another and away from one another by means of at least one driving device.

The driving device may drive at least one belt. The belt may be coupled at least temporarily with at least one centering unit. At least part of the centering units disposed on both sides opposite one another are in particular coupled with at least one belt of the driving device at least temporarily.

Preferably at least one centering unit provided on a first side is at least temporarily coupled with the return side of at least one rotating belt. It is preferred that at least one centering unit provided on a second side is at least temporarily coupled with the carrying side of at least one rotating belt.

Preferably at least one centering unit is at least temporarily disposed displaceably in a groove of the stacking device. Preferably at least one centering unit is provided in a first position beneath a plate of the stacking device. Preferably at least this centering unit protrudes in a third position through the groove beyond the top surface of the plate of the stacking device.

It is preferred to provide an adjustable stopper that defines a bag width. The adjustable stopper may be provided to be displaceable. The adjustable stopper and/or a centering unit may have a displacement sensing device assigned to it to enable automatic adjustment of the bag width.

It is possible for a centering unit to be coupled with the belt via a coupling mechanism. The coupling mechanism may comprise a spring device. The coupling mechanism preferably comprises at least one coupling unit and at least one movable stopper. The coupling mechanism is in particular configured and fitted for establishing a coupling between the centering unit and the belt at least in the second and/or third position. The coupling mechanism is preferably configured and fitted so that in the first position a coupling between the centering unit and the belt is disconnected.

A separate driving unit may be provided for displacing the at least one centering unit on one side.

The method according to the invention serves for processing at least one stack of bags comprising a plurality of open-mouth bags. The stack of bags is disposed on a stacking device in a base position. At least one bag conveying device is provided. Preferably at least one marker device is provided. The bag conveying device grips the topmost and in particular only the topmost bag from the stack of bags in the base position and displaces the topmost open-mouth bag to a take-up position so that it lies only partially on the stack of bags. In the take-up position the open-mouth bag is preferably marked by means of the marker device.

The method according to the invention also has many advantages since it allows dependable function with small mounting space and high output.

BRIEF DESCRIPTION OF THE DRAWINGS

Further advantages of the present invention can be taken from the exemplary embodiment which will be described below with reference to the enclosed figures.

The figures show in.

DETAILED DESCRIPTION

Figure 1:
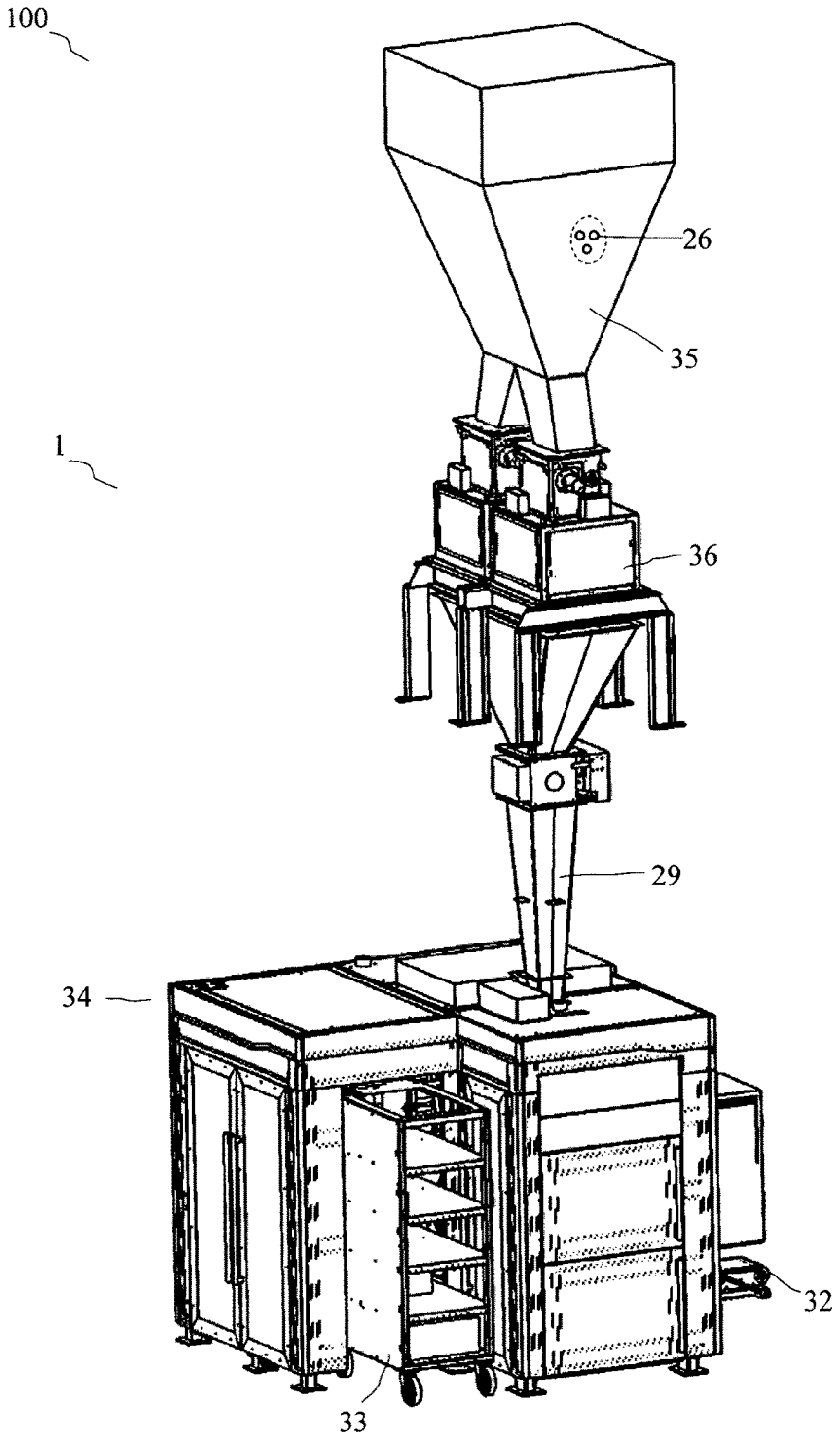
FIG. 1 a schematic perspective of the processing device 1.

FIG. 1 shows a perspective total view of a packaging machine 100 comprising a processing device 1. A silo 35 is provided from which the bagged bulk material 26 is conveyed to a dosing and weighing device 36. In the exemplary embodiment a weighing system with net-weighing devices is employed where the bagged product 26 is first collected in a net-weighing device and thereafter filled into the respective open-mouth bag 3. Beneath the dosing device 36 the product feeder 29 is provided that ends in the filling spout 30 not shown in FIG. 1.

A casing 34 surrounds the processing device 1. A bag stacking magazine 33 serves to accommodate a number of stacks of bags 2. The filled open-mouth bags 3 are conveyed off via a discharge device 32.

Figure 2:
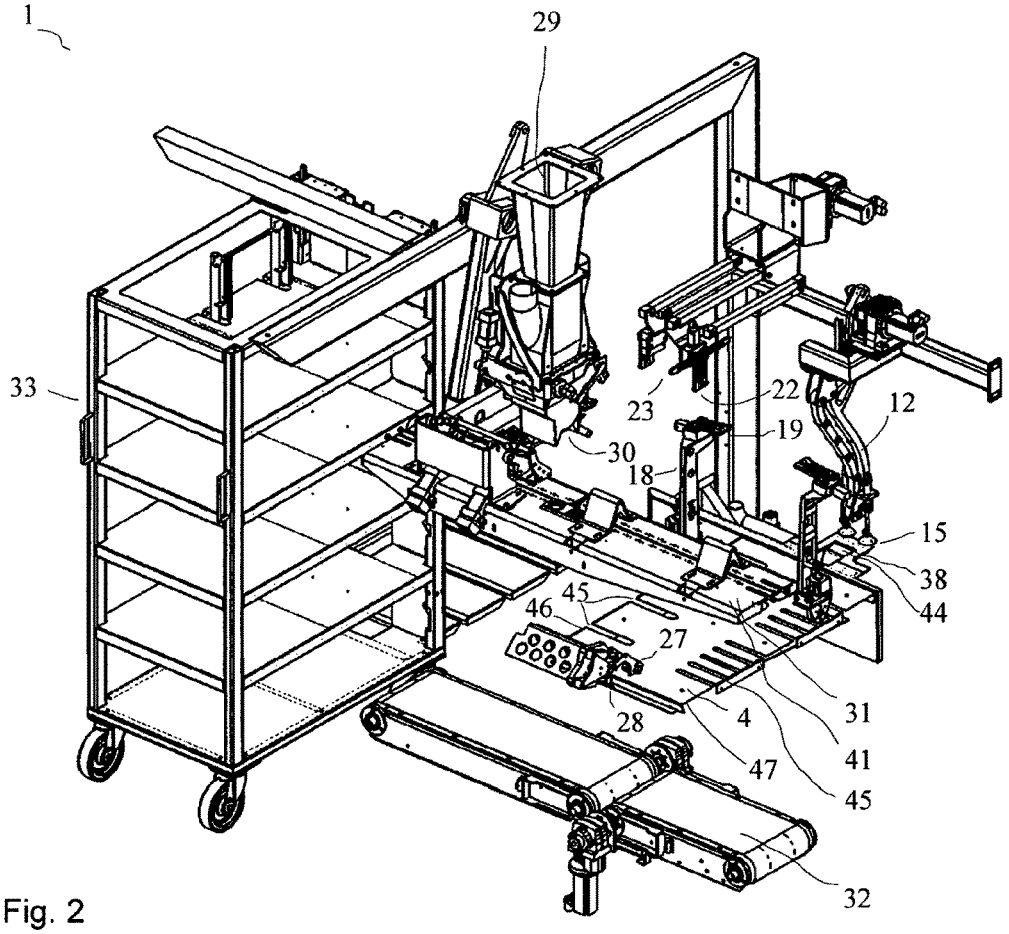
FIG. 2 a simplistic view of the processing device according to FIG. 1 with some components omitted.

FIG. 2 shows a schematic, perspective view of the processing device 1 with the housing and other components omitted.

The product feeder 29 can be identified in the upper region and it opens into the filling spout 30. A stack of bags 2, not shown, is conveyed from the bag stacking magazine 33 to the stacking table 4. The stacking table 4 has dimensions that may approximately correspond to the bag length 6 and the bag width 48. Open-mouth bags 3 variable in bag length 6 can in particular be processed.

A stack of bags 2 is centered by means of a centering device 50 not shown in FIG. 2. This centering device 50 will be described in detail below with reference to the FIGS. 12 to 17. For centering, tines 51 and 52 of the centering device 50 approach the stack of bags from outside through the grooves 45 of the stacking table 4 provided on the two sides 46, 47. The tines 52 are pivoted upwardly from beneath on the side 47 and then moved toward the stack of bags 2, thus centering the stack of bags 2.

The processing device 1 basically works without such a centering device 50. It has been found though that in particular in the case of stacks of bags 2 comprising a comparatively large quantity of open-mouth bags 3 and/or given high processing speeds the open-mouth bags 3 of the stack of bags 2 may slip sideways or else may be gripped at a slight angle. This may adversely affect a highly precise and fast filling of open-mouth bags 3.

This is reliably prevented by means of a centering device 50 disposed substantially beneath the stacking device 4. Depending on the configuration the tines 51 and 52 of the centering device 50 may be beneath the stacking device 4 when a new stack of bags 2 is positioned on the stacking device 4 to allow the stack of bags to be pushed onto the stacking device 4.

In particular in the case of long, narrow open-mouth bags 3 the bag bottom may drift sideways while the open-mouth bag 3 is transferred to the take-up position. This is reliably prevented by guiding by the centering device 50.

The rear end of the stacking table 4 is provided with the lifting device 27 and the fixing device 28 for lifting the bottom end of an open-mouth bag 3 disposed on the stacking device 4. Subsequently to lifting the bottom end the remainder of the stack of bags 2 lying beneath is fixed by means of the fixing device 28.

At the front end of the stacking device 4 one can recognize the bag conveying device 12 the lower end of which is provided with a suction device 15 or in other cases, with a friction gear for gripping the open filling mouth 8 of an open-mouth bag 3.

Figure 6:
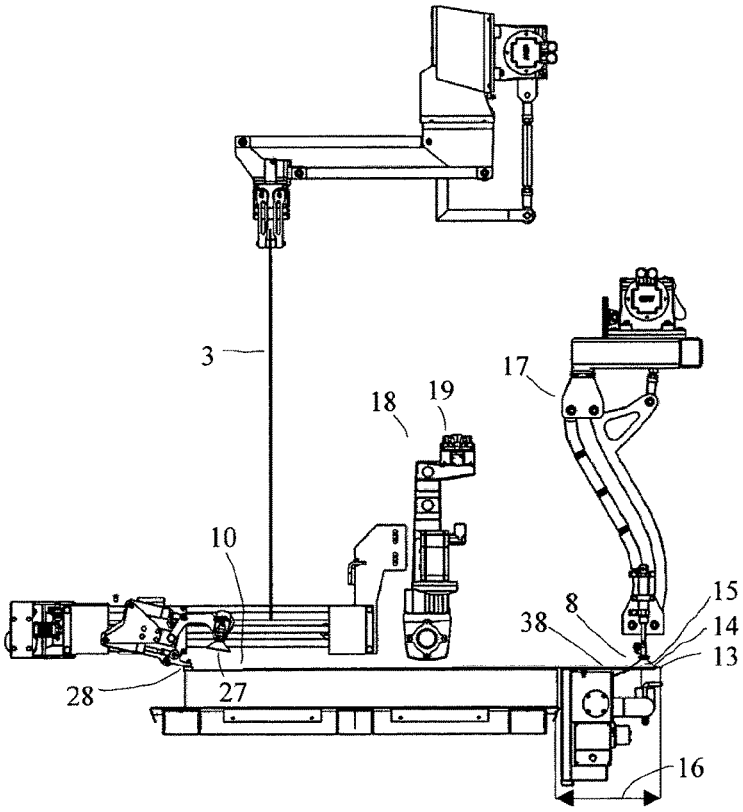
FIG. 6 a fourth view of the processing device according to FIG. 3.

The open-mouth bag 2 is displaced by means of the bag conveying device 12 to a front position as it is illustrated in FIG. 6. The filling mouth 8 of the topmost open-mouth bag 13 rests on the supporting device 38. In this position the open filling mouth 8 is accessible from beneath in the marking area 44 visible in FIG. 2. Then the marker device 25 that is provided beneath the supporting device 38 and therefore not identifiable in FIG. 2 can put at least one mark 7 on the open-mouth bag 3. A pivot device 18 is equipped with a gripper device 19. The pivot device 18 comprises a pair of pivot arms with a gripper disposed at each of their ends. The pivot device serves to take over a separated open-mouth bag 3 and to transfer it and hand it over to a bag opener 22 and a bag appending device 23 which ultimately append the opened open-mouth bag 3 to the filling spout 30.

After the open-mouth bag 3 has been filled through the filling spout 30 the open filling mouth 8 of an open-mouth bag 3 is conveyed further by means of the top conveying device 41. The top conveying device 41 may comprise a closing device 31 for closing the open-mouth bags 3, or a separate closing device is disposed downstream. The filled open-mouth bag 3 is finally transferred to the discharging belt 32 and discharged.

Figure 2B:
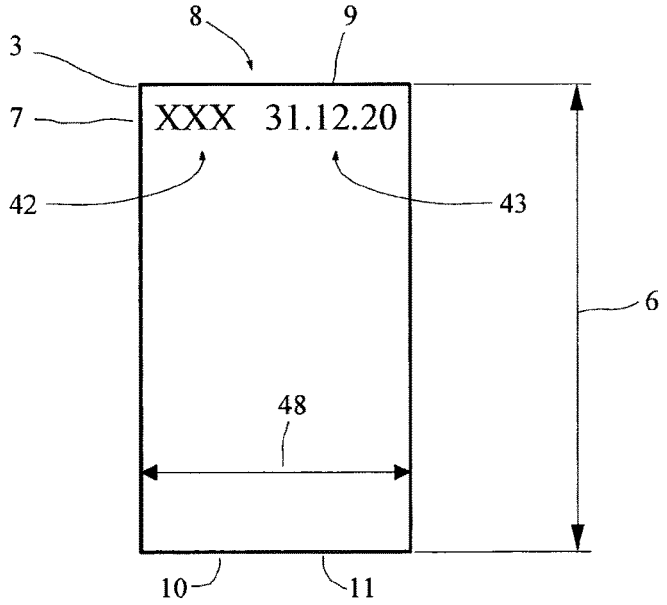
FIG. 2*b* a top view of an open-mouth bag after marking.

FIG. 2*b* illustrates exemplarily a simplistic open-mouth bag 3 in a top view or a view from beneath respectively. The open-mouth bag 3 is provided with a mark 7 made by the marker device 25. The marker device 25 is disposed substantially beneath the stacking device 4 and makes the mark 7 in the marking area 44.

Figure 3:
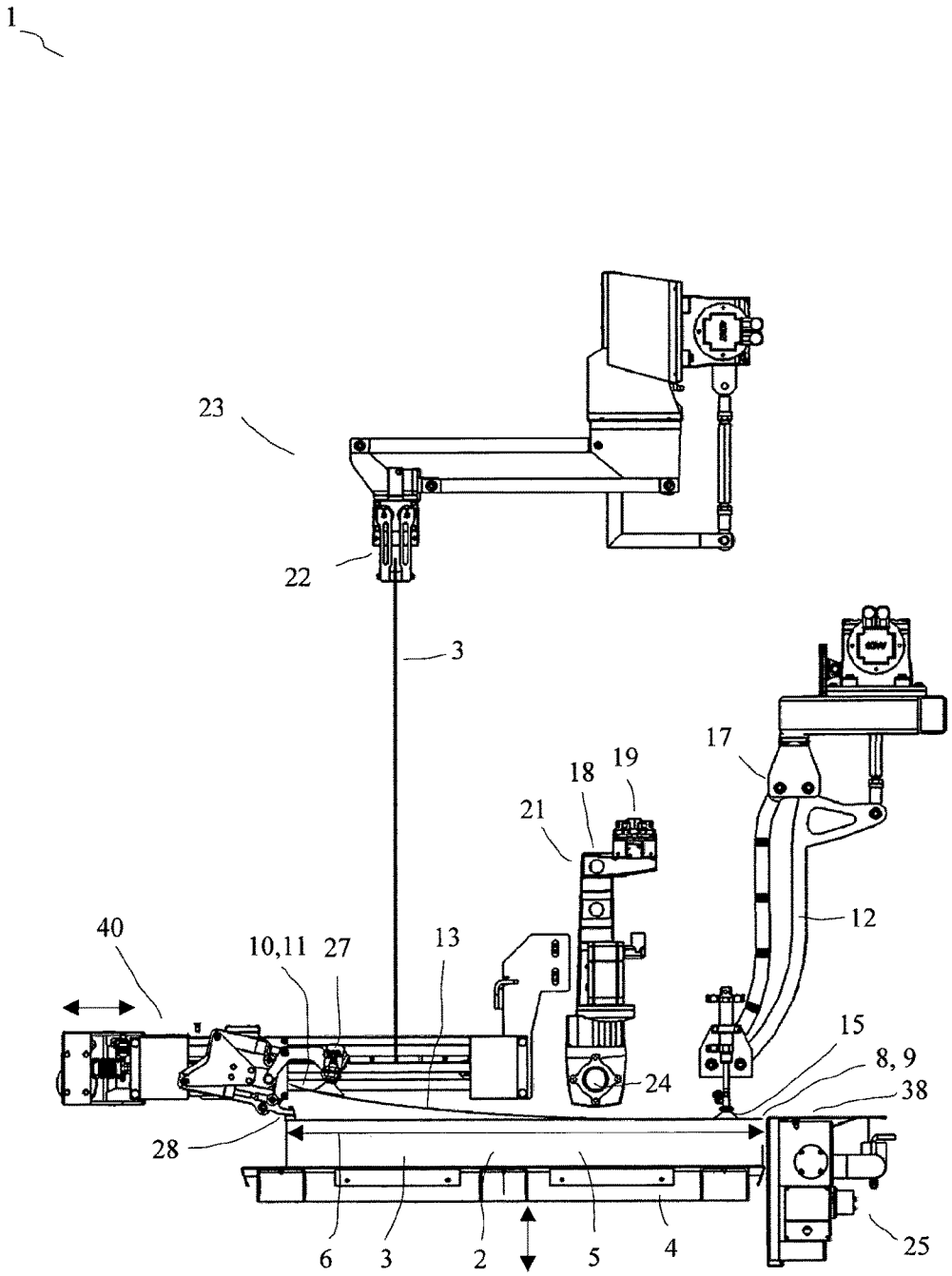
FIG. 3 a side view of parts of the processing device according to FIG. 2 in a side view.

The mark 7 includes a designation 42 ("XXX") and a date 43 ("31.12.20"). The designation 42 may correspond to the trade name or the trademark or else comprise a unique number or the like that preferably unambiguously classifies the contents. The date 43 may indicate or include the best-before date or else for example the bagging date and/or the manufacturing date. It is possible to put multiple designations 42 and/or multiple dates 43 on the open-mouth bag 3. The data may be printed, punched, or e.g. applied by laser. Electronic data transmission to a readable memory is likewise possible. FIG. 3 shows a schematic side view of some of the essential components of the processing device 1. Some of the components and the housing of the processing device have been omitted to facilitate overview and to explain the function.

The processing device 1 comprises a height-adjustable stacking device 4 where a stack of bags 2 has been disposed or is being disposed in the base position 5. The stack of bags 2 comprises a plurality of open-mouth bags 3, each having a specified bag length 6 and bag width 48. The open-mouth bags 3 are aligned with the front end of the stacking device 4 by their open filling mouths 8 while the bag bottom 10 is disposed at the rear end of the stacking device 4 forming a stack.

In this exemplary embodiment the open-mouth bags 3 have a bag length 6 corresponding to about the length of the stacking device 4. Longer and in particular shorter open-mouth bags 3 may be used as well. For setting the position of the lifting device 27 and the fixing device 28, an adjusting device 40 is provided that can be displaced in the direction of the bag length 6.

In the position shown in FIG. 3 the lifting device 27 has gripped and lifted the rear end of the open-mouth bag 3 in the vicinity of the bag bottom 10. Subsequently to lifting, the fixing device 28 moves beneath the topmost bag 13 and fixes the remainder of the stack of bags 2 at the bag bottom 10.

The bag conveying device 12 at the front end 9 has an extending suction device 15 which in the position illustrated in FIG. 3 is extended and has lowered to an area at the open filling mouth 8. The suction device 15 is activated in this state, gripping the front filling mouth 8 of the topmost open-mouth bag 13.

Furthermore a pivot device 18 is provided to take over a separated open-mouth bag 3. The pivot device 18 has a gripper device 19 and is illustrated in FIG. 3 in the second pivot position 21. The pivot device 18 is disposed to pivot about the pivot axis 24. The pivot device 18 serves to take over the topmost open-mouth bag 13 from the take-up position 14 and after the pivot device 18 pivots to the second pivot position 21 it is transferred to the bag opener 22 and the bag appending device 23 shown above the pivot device 18 where an appended open-mouth bag 3 is illustrated in the FIG. 3.

Figure 4:
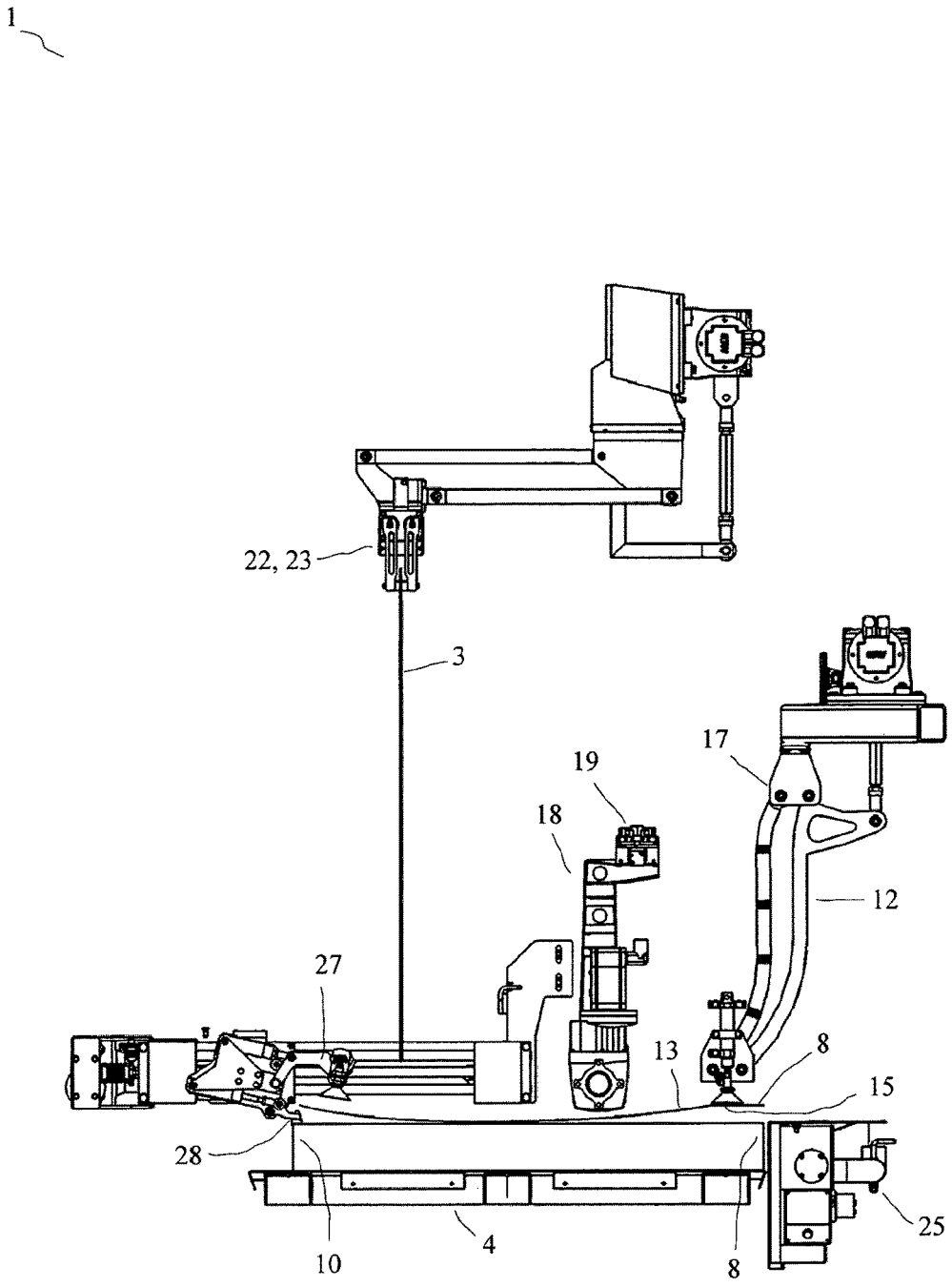
FIG. 4 another view of the processing device according to FIG. 3.

FIG. 4 shows the situation after retracting the suction device 15 at the bag conveying device 12 so that the filling mouth 8 of the topmost open-mouth bag 13 is lifted off the stack of bags 2. At the same time the lifting device 27 at the other end 11 can be deactivated so that the bag bottom 10 falls back down onto the stack of bags 2 retained by the fixing device 28.

Figure 5:
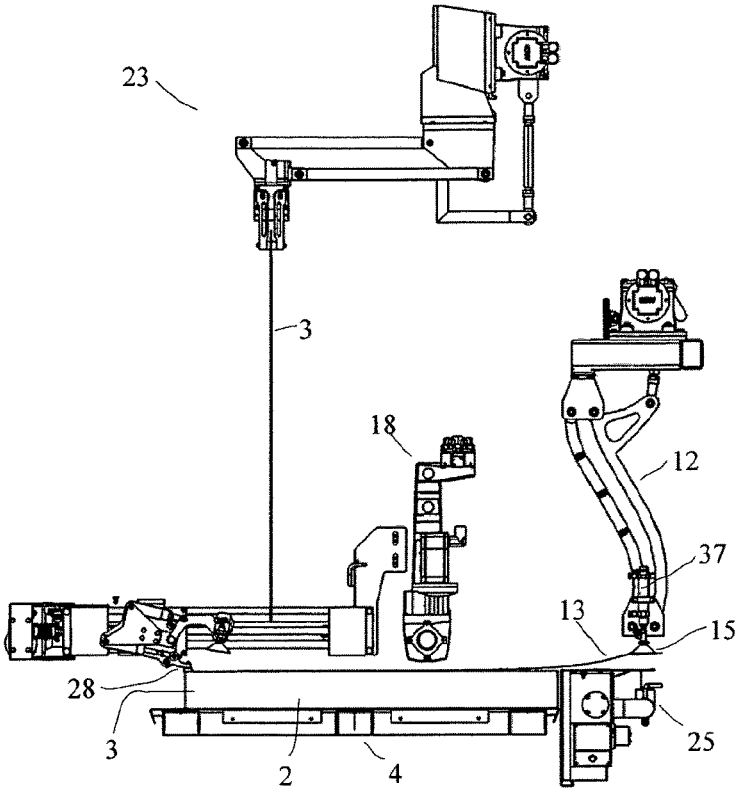
FIG. 5 a third view of the processing device according to FIG. 3.

FIG. 5 shows the position after the bag conveying device 12 has traveled to a front position where the filling mouth 8 of the topmost open-mouth bag 13 lies above the take-up position 14. Accordingly both the open filling mouth 8 and the bag bottom 10 have been displaced forwardly by a distance 16 in the direction of the open filling mouth 8. It is possible to pivot the bag conveying device 12 about one or more pivot axes 17. A different linear movement or a motion resulting in a linear movement is also possible. During the forwardly movement of the bag conveying device 12 the fixing device 28 fixes the rear end of the stack of bags 2 so as to ensure that only one, specifically the topmost, of the open-mouth bags 13 is pulled forward by way of the movement of the bag conveying device 12. This is to realize an efficient separation of the open filling mouth 8 of the open-mouth bag 13.

In transfer from the position shown in FIG. 5 to that shown in FIG. 6 the suction device 15 is displaced downwardly by means of the cylinder device 37 so that the open filling mouth 8 rests on the supporting device 38. In this position the open filling mouth 8 is accessible from beneath at least in part so that the marker device 25 provided beneath the supporting device 38 can apply at least one mark on the open-mouth bag. The marker device may for example include a laser that applies one or more letters or characters to the outer surface of the open-mouth bag 13. It is for example possible to mark or label the open filling mouth of the open-mouth bag 13 with the filled product, the batch number, the filling date or the best-before date of foodstuff by embossing or spraying the open filling mouth or in some other way.

A marker beam of the marker device may be directed at the bag immediately from beneath or else it may be deflected by mirrors so as to protect the optics from dirt.

In FIG. 6 one can see that the distance 16 by which the topmost open-mouth bag 13 is pulled forward toward its open filling mouth 8 represents only a minor portion of the bag length 6. The distance 16 can be selected as is suitable for the application.

Figure 7:
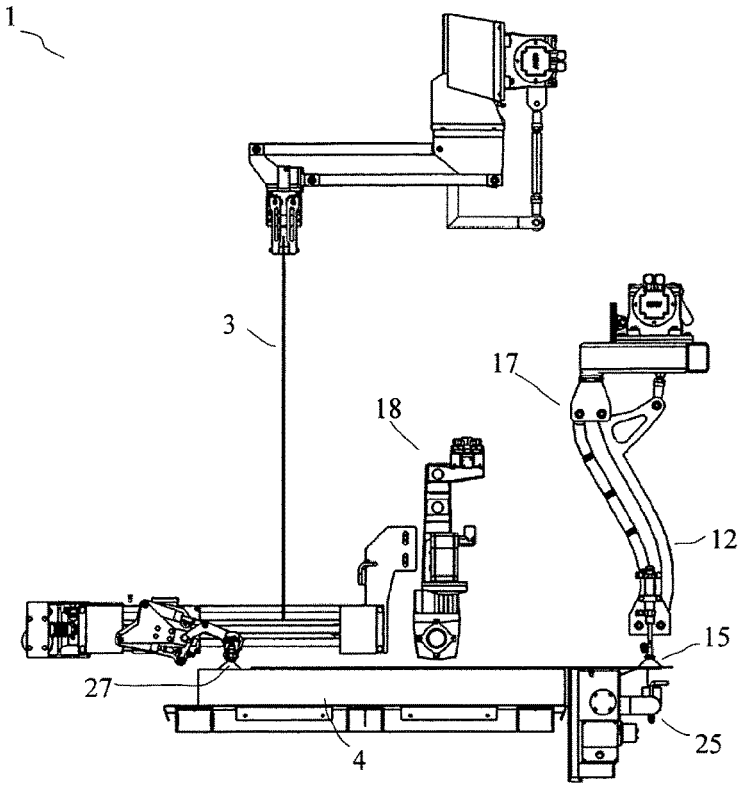
FIG. 7 a fifth view of the processing device according to FIG. 3.

FIG. 7 shows a situation where the lifting device 27 has been lowered back down onto the rear end of the stack of bags 2 for gripping and then lifting the bag bottom 10 of the next open-mouth bag 3.

Figure 8:
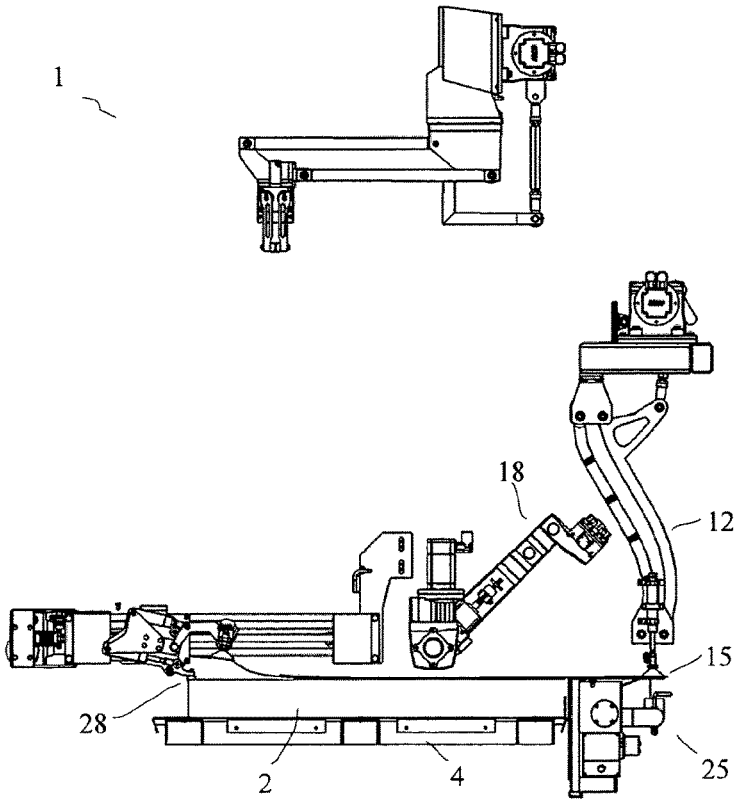
FIG. 8 a sixth view of the processing device according to FIG. 3.
Figure 9:
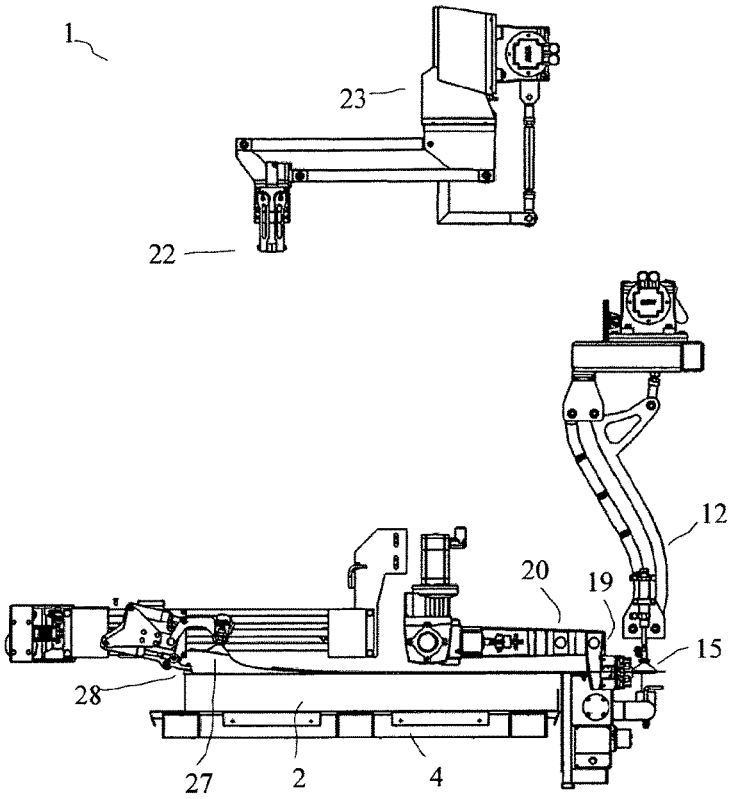
FIG. 9 a seventh view of the processing device according to FIG. 3.

This is the situation illustrated in FIG. 8. At the same time the pivot device 18 pivots from the second pivot position 21 shown previously to a first pivot position 20 illustrated in FIG. 9. In pivoting from the pivot position 21 to the pivot position 20 the gripper device 19 moves from a position noticeably above the stacking device 4 to a position at the level of the stacking device 4 while the gripper device is moved in the longitudinal direction of the open-mouth bags from a central region of the open-mouth bags 3 to the front end.

While the gripper device 19 is pivoting the lifting device 27 with the bag bottom 10 remains lifted and the fixing device 28 lowers down to the bottom area of the remaining stack of bags 2. At the same time the bag conveying device 12 travels forward some more so as to avoid collision with the pivot device 18. Depending on the configuration it is also possible for the bag conveying device to remain between the two pivot arms of the pivot device 18 as the pivot device pivots downwardly. In the subsequent pivoting motion from the pivot position 20 to the pivot position 21 the bag conveying device 12 is at any rate moved out of the path of motion.

Figure 10:
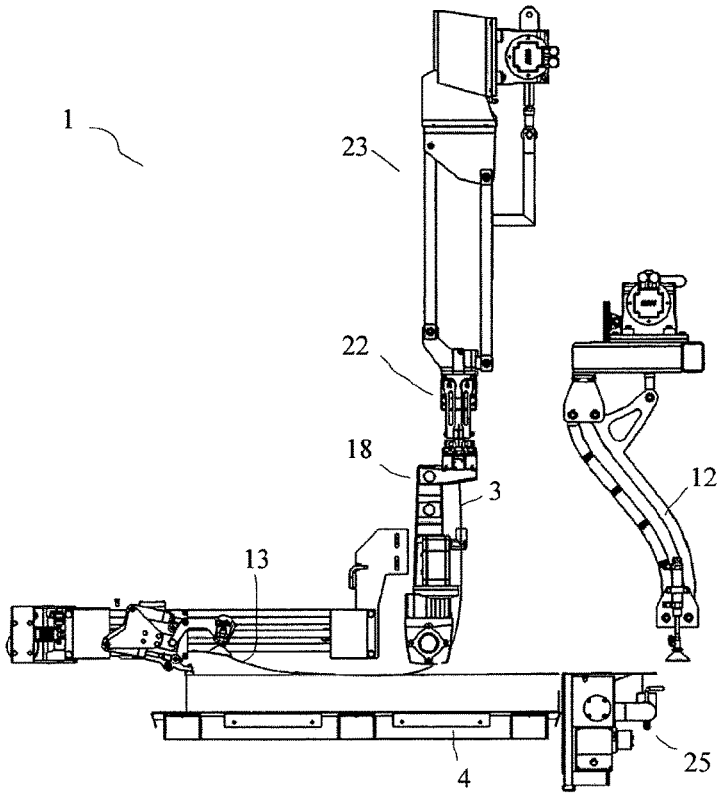
FIG. 10 an eighth view of the processing device according to FIG. 3.

FIG. 10 shows the position in which the pivot device 18 in the upper, second pivot position 21 transfers the open-mouth bag 3 hanging off the gripper device 19 to the bag opener 22 and the bag appending device 23. During pivoting from the pivot position 20 to the pivot position 21 the gripper device 19 moves upwardly and returns, viewed in the longitudinal direction of the open-mouth bags. Thus in the pivot position 21 the open-mouth bags are hanging in a center area above the stacks of bags 2. The gripper device 19 does not require more mounting space or a larger footprint due to pivoting.

Now another open-mouth bag is the topmost open-mouth bag 13 lying on the stack of bags 2. The stacking device 4 is automatically lifted such that what is now the topmost open-mouth bag 13 is approximately on the same level as is the supporting device 38 so that the topmost open-mouth bag 13 can later be taken over by the bag conveying device 12.

In the position illustrated in FIG. 10 the bottom end 10 of the open-mouth bag 13 has been lifted and the fixing device 28 has fixed the bottom end of the stack of bags 2. The bag conveying device 12 is in an advanced position in which the pivot device 18 can pivot to the upper, second pivot position 21.

Figure 11:
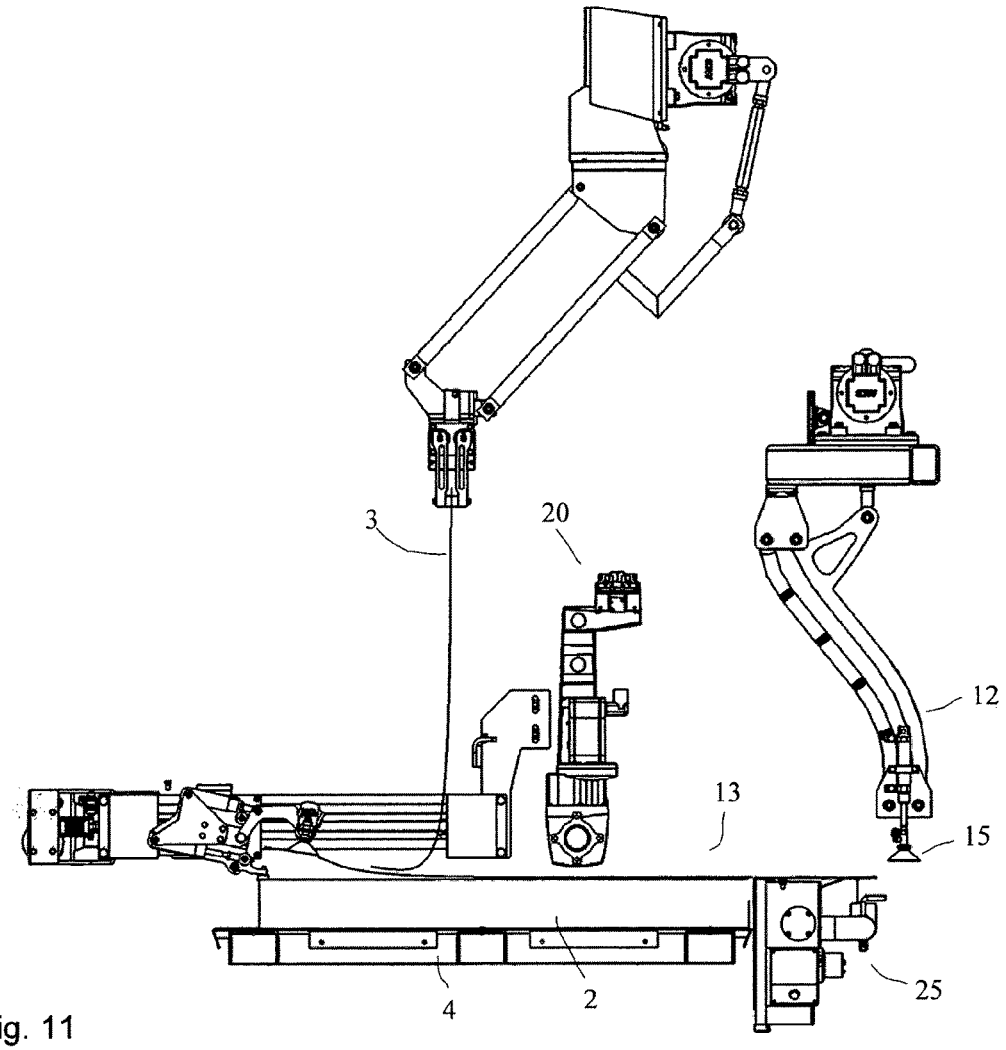
FIG. 11 a ninth view of the processing device according to FIG. 3.

FIG. 11 shows the position after handover of a bag 3 to be filled, from the pivot device 18 to the bag opener 22 and the bag appending device 23. What is now the topmost open-mouth bag 13 is still lifted by its bottom end by the lifting device 27. Thereafter the bag conveying device 12 is moved back again such that the suction device 15 grips the open filling mouth 8 of what is now the topmost open-mouth bag 13, lifts it and transfers it to the take-up position 14.

Figure 12:
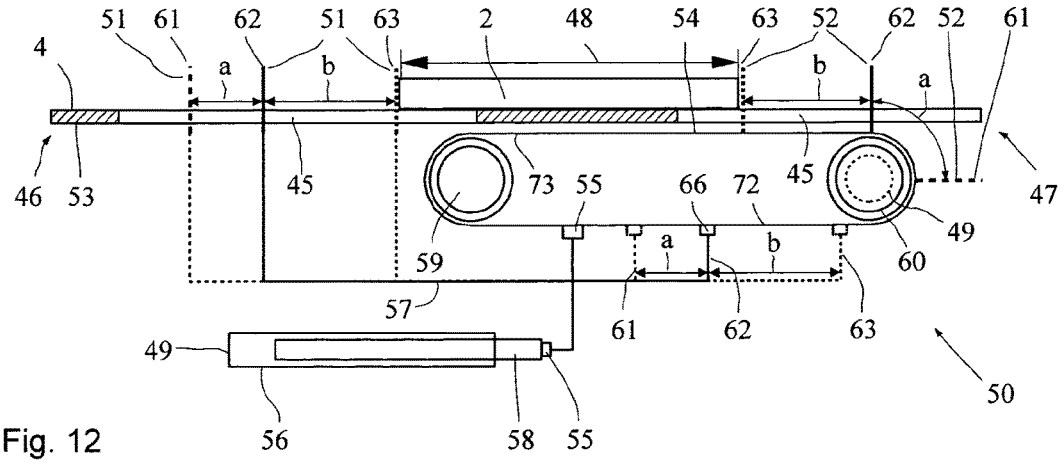
FIG. 12 a side view of a simplistic processing device.

FIG. 12 illustrates a processing device 1 in a simplistic, sectional side view substantially showing the centering device 50 at the schematically illustrated stacking device 4. The centering device 50 is substantially located beneath the stacking device 4 or beneath the plate 53 of the stacking device 4. The plate 53 of the stacking device 4 is illustrated in section. The section is through the region of the grooves 45.

FIG. 12 shows a diagrammatic illustration of a first variant where the centering device 50 of the processing device 1 is provided with a pair of pulleys 59 and 60 which are surrounded by a circumferential belt 54. The belt 54 which is presently entirely circumferential has the centering finger 52 attached to it such that the centering finger 52 protrudes perpendicularly or approximately perpendicularly from the belt 54. This means that as the pulleys 59 and 60 rotate, the centering finger 52 with the belt 54 is conveyed further although it projects perpendicularly away from the belt 54.

It is possible for one of the pulleys 59 and 60 to be driven via a motor, presently shown in dashed lines at the pulley 60, provided as the driving device 49 for driving the belt 54. However, it is also possible for a cylinder 56 with an extendable piston rod 58 to serve as the driving device 49. The piston rod is firmly connected with the belt 54 via an engaging dog 55. Extending the piston rod 58 therefore causes a synchronous, counterclockwise movement of the belt 54 in the orientation of FIG. 12. Reversely, the belt 54 moves clockwise as the piston rod 58 is retracted.

FIG. 12 shows three different positions 61, 62 and 63 of the centering device 50. The second position 62 is shown in a solid line while the first position 61 and the third position 63 are shown in dotted lines.

In the first position 61 the centering unit 51 configured as a centering finger is on the left 46, farthest remote from the illustrated stack of bags 2. The centering unit provided on the other side 47 and likewise configured as a centering finger 52 is disposed in the position 61 beneath the plate 53. Since in the position 61 the tine or centering finger 52 is beneath the plate 53, a new stack of bags 3 can be pushed from the side 47 at least approximately to the base position 5.

As the piston rod 58 is extended out of the cylinder 56, the connection point 55 at the belt 54 travels the distance "a" in synchrony and is displaced toward the pulley 60. In this way the centering finger 51 is pivoted from the first position 61 beneath the plate 53 through the groove 45 to a position 62 that is at least partially above the plate 53, by the distance "a" and at the same time, during transfer from the first position 61 to the second position 62, the centering finger 51 coupled with the drive belt 54 is transferred by the same distance "a" to the position 62 which is noticeably closer to the stack of bags 2.

As the piston rod 58 is extended further out of the cylinder 56 by the distance "b", the centering finger 52 that is coupled with the carrying side 73 travels from the right toward the stack of bags 2 by the distance "b" in the diagram of FIG. 12 while in the illustration according to FIG. 12 the centering finger 51 travels from the left toward the stack of bags by the same distance "b". Finally the extended position is reached in which the third position 63 is reached.

The centering fingers 51 and 52 bear directly against the stack of bags 2. By way of the transfer of the centering fingers 51 and 52 each of the open-mouth bags 3 of the stack of bags 2 has been positioned in the third position 63 and centered.

The distance traveled of the piston rod 58 and in particular the distance "b" is matched to the current bag width 48 of the processed open-mouth bags 3.

The centering device 50 allows ease and reliability in centering stacks of bags 2. Moreover, multiple centering units 51 and 52 placed in series one after the other provide a guide when pulling off the open-mouth bags 3. Even if a processed open-mouth bag is briefly entirely released for example in the take-up position 14 before the gripper device 19 grips the top filling mouth 8 of the open-mouth bag 3, the centering device 50 ensures a defined position of the open-mouth bag 3. It has been found that, given high processing speeds and specific bag materials, some open-mouth bags may slightly slip sideways on the stack of bags in the absence of a centering device 50. A centering device 50 equipped with multiple centering units with the centering units positioned in series one after the other will show a reliable and reproducible separation and positioning even of long, narrow open-mouth bags, to then be filled.

With reference to the FIGS. 13 to 15 another exemplary embodiment will be discussed where the centering device 50 is provided with a coupling mechanism 70 to allow temporary decoupling of at least one centering unit 51 from the movement of the circumferential belt 54.

The driving device 49 is once again a cylinder 56 with an extendable piston rod 58 or else a driven pulley. An engaging dog 55 is connected with the piston rod 58. The engaging dog 55 is connected with the circumferential belt 54.

The engaging dog 55 is provided with a movable stopper 67 that moves relative to a gliding rod 64 and a coupling rod 57. In this way the movable stopper 67 can be displaced on the gliding rod 64. The relative motion between the gliding rod 64, the coupling rod 57 and the movable stopper 67 is limited by the coupling unit 66 that is configured as a coupling sheet.

Figure 13:
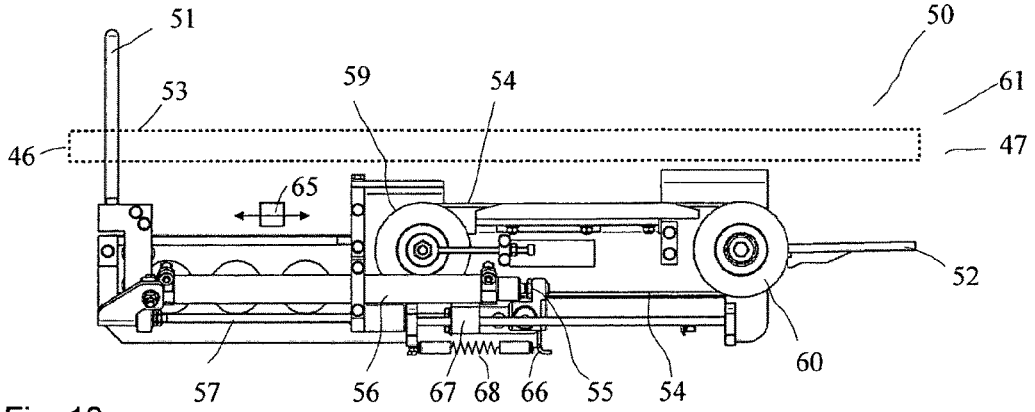
FIG. 13 the centering device of the processing device according to FIG. 2 in a first position.

Firstly, in the first position illustrated in FIG. 13 the coupling between the coupling unit 66 and the movable stopper 67 is released so that as the piston rod 58 extends, the movable stopper 67 fixedly disposed on the engaging dog 55 moves along and glides on the gliding rod 64. Further extending has the movable stopper 67 abut against the coupling unit 66 so that then the coupling rod 57 and the coupling rod 58 will move in synchrony. In this way, as the coupling rod 58 extends further out of the cylinder 56, not only the belt 54 is conveyed but so is the centering unit 51 connected therewith via the coupling rod 57.

While during transfer of the centering unit 52 from the first position 61 (see FIG. 13) to the second position 62 (see FIG. 14), firstly only the centering unit 52 pivots upwardly from the region beneath the plate 53, the first centering unit 51 will also be linearly displaced as the second position 62 is reached. In the case that the first centering unit were fixedly coupled to the belt 54, the first centering unit 51 would already be in the position shown in the hatched field in FIG. 14 after transfer to the second position 62. Then, more mounting width would be required.

Thereafter the centering units 51 and 52 are displaced toward one another. Extending of the piston rod 58 out of the cylinder 56 is limited by an adjustable stopper 65 that can be adjusted laterally. When, as the piston rod 58 extends further, the centering unit 51 abuts against the adjustable stopper 65, the piston rod 58 is prohibited from extending further. The position of the adjustable stopper 65 is set such that in this position the centering units 51 and 52 adequately center the stack of bags 2 with the open-mouth bags 3. The position of the adjustable stopper 65 is in particular adapted to the width 48 of the open-mouth bags 3, specifying an intended end position of the centering units 51, 52 offset relative to the center line 69 substantially by half the bag width.

Figure 15:
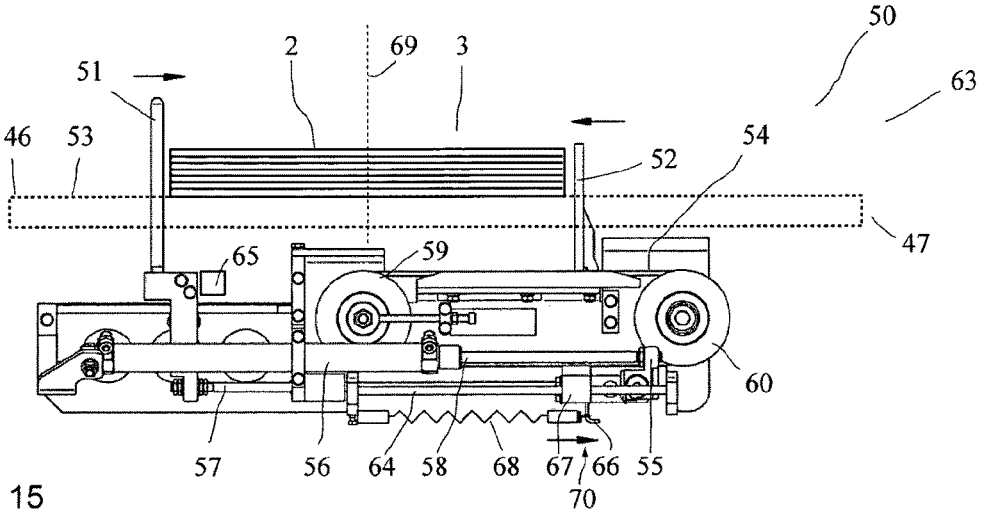
FIG. 15 the centering device of the processing device according to FIG. 2 in a third position.

This position is illustrated in FIG. 15. The coupling device 70 with the presently linked coupling device 66 and the adjustable stopper 65 are coupled to one another. For better understanding FIG. 15 shows on both sides of the stack of bags 2 small distances from the centering fingers 51 and 52 which may, though do not need to, be present when actually centering a stack of bags 3.

As the piston rod 58 retracts back into the cylinder 56, the spring force of the spring device 68 acts, causing a transfer to the first position 61 illustrated in FIG. 13.

Figure 16:
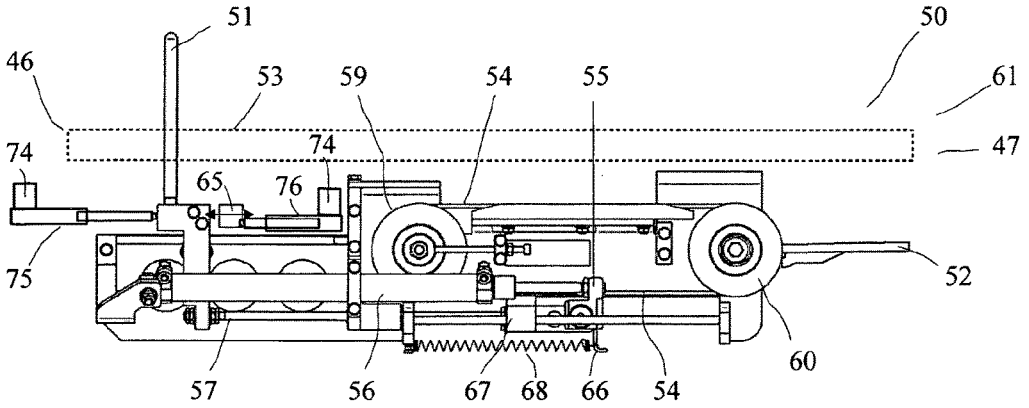
FIG. 16 another centering device for a processing device according to FIG. 2 in a first position.

With reference to the FIGS. 16 and 17 another exemplary embodiment will now be discussed. FIG. 16 is a simplistic view of the processing device 1 with the centering device 50 and the plate 53 of the stacking device. In this configuration the centering device 50 is additionally provided with a driving unit 75 for separately moving the centering unit 51.

An adjustable stopper 65 is again provided that is adjusted to the bag width 48. The adjustable stopper 65 is provided displaceable by way of a driving unit 76. A travel measuring device 74 can capture the position of the adjustable stopper 65 and/or the distance traveled by the centering unit 51 or a measure characteristic thereof. Thus the travel capturing device 74 allows for example computer-controlled adjustment of the bag width 48. In this way the bag width 48 can be set automatically for processing bags of different widths.

Although such a travel capturing device is not shown in the preceding exemplary embodiments, it is preferably provided therein.

In the embodiment variant illustrated in FIG. 16 the centering unit 51 is positioned at the stopper 65 immediately above the driving unit 75. This means that the centering unit 51 is directly transferred to its end position which corresponds to the position 63 in the preceding example according to FIG. 14. The centering unit 52, however, remains in the first position 61 beneath the plate 53.

Now when the stack of bags 2 is intended to be centered, the piston rod 58 of the cylinder 56 is extended. The belt 54 is conveyed immediately further and the centering unit 52 pivots upwardly around the pulley 60 and through the groove 45 in the plate 53.

Thereafter the centering unit 52 travels toward the first centering unit 51 as the cylinder 58 extends further until the third position 63 and thus the end position is reached.

Figure 17:
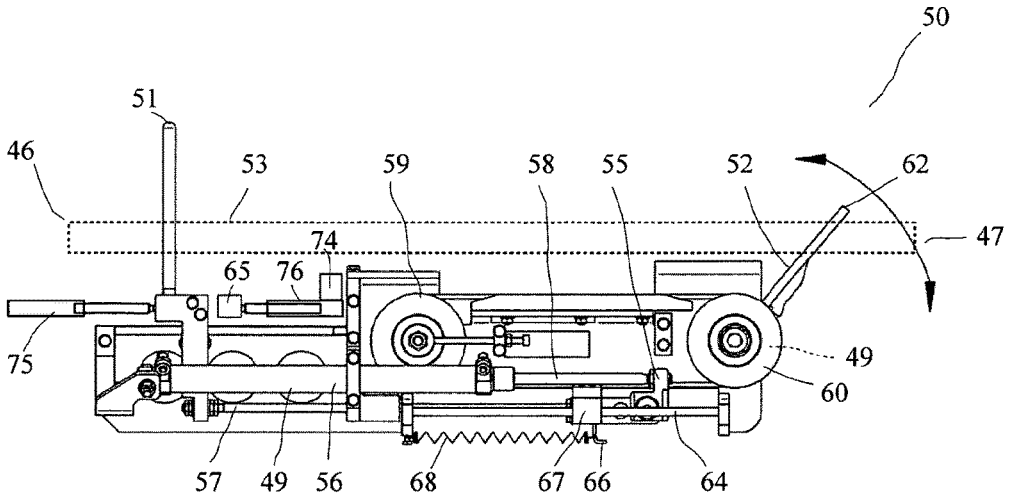
FIG. 17 the centering device according to FIG. 16 in a second position.

FIG. 17 shows the intermediate position of the centering unit 52 in the second position 62.

In the third position 63 a position will result as it has been illustrated in FIG. 15 and discussed with reference to the preceding exemplary embodiment.

On the whole the invention provides an advantageous processing device that allows reliable centering and/or separating of bags.

Figure 14:
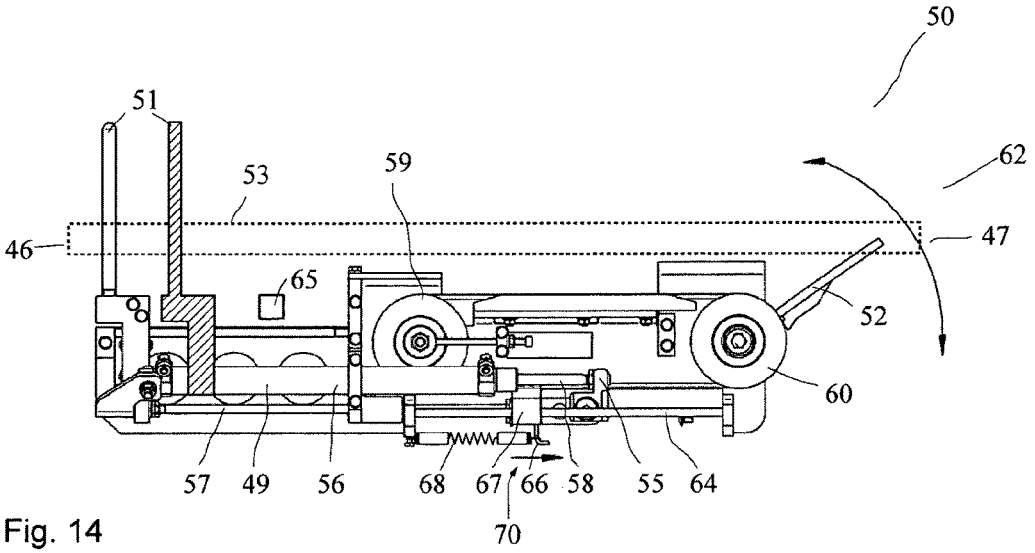
FIG. 14 the centering device of the processing device according to FIG. 2 in a second position.

The centering device according to FIGS. 13 to 15 allows centering and reliable positioning a stack of bags 2, with the centering units 51 and 52 approaching the stack of bags 2 from both sides 46 and 47. In the exemplary embodiment according to FIGS. 16 and 17 the stack of bags is positioned at an end stopper which is formed by the centering units 51. For the further centering the centering units 52 approach the stack of bags 2 from the other side 47.

In the further processing and separating the open-mouth bags 3 are guided by the centering units 51 and 52 in an advantageous way so as to reliably prevent the open-mouth bags 3 from slipping sidewardly during pulling and in the further processing.

On the whole the invention provides an advantageous processing device and an advantageous method which allow to reliably and efficiently separate open-mouth bags from a stack of bags. The required footprint and also the required space are low. The output can be considerably increased over the prior art thus resulting in advantages of both mounting space and capacity. In the take-up position, marks and other applications can be applied on the open-mouth bag.

The processing device 1 can be controlled by a control device, not shown, provided with one or more light barrier (s) or other sensors to ensure defined positioning during the entire operation.

The compact design allows noticeably reduced space requirements so as to allow considerably increased bagging capacities within the same mounting space.

LIST OF REFERENCE NUMERALS

| | |
|---|---|
| 1 | processing device |
| 2 | stack of bags |
| 3 | open-mouth bag |
| 4 | stacking device |
| 5 | base position |
| 6 | bag length |
| 7 | mark |
| 8 | open filling mouth |
| 9 | one end |
| 10 | bottom, bag bottom |
| 11 | other end |
| 12 | bag conveying device |
| 13 | topmost open-mouth bag |
| 14 | take-up position |
| 15 | suction device |
| 16 | distance |
| 17 | pivot axis |
| 18 | pivot device |
| 19 | gripper device |
| 20 | first pivot position |
| 21 | second pivot position |
| 22 | bag opener |
| 23 | bag appending device |
| 24 | pivot axis |
| 25 | marker device |
| 26 | bulk material |
| 27 | lifting device |
| 28 | fixing device |
| 29 | product feeder |
| 30 | filling spout |
| 31 | closing device |
| 32 | discharge device |
| 33 | bag stacking magazine |
| 34 | casing |
| 35 | silo |
| 36 | dosing and weighing device |

-continued

| | |
|---|---|
| 37 | cylinder device |
| 38 | supporting device |
| 40 | adjustment device |
| 41 | upper conveying device |
| 42 | designation |
| 43 | date |
| 44 | marking area |
| 45 | groove |
| 46 | side |
| 47 | side |
| 48 | bag width |
| 49 | driving device |
| 50 | centering device |
| 51 | centering unit, centering finger |
| 52 | centering unit, centering finger |
| 53 | plate |
| 54 | belt |
| 55 | engaging dog |
| 56 | cylinder |
| 57 | coupling rod |
| 58 | piston rod |
| 59 | pulley |
| 60 | pulley |
| 61 | first position |
| 62 | second position |
| 63 | third position |
| 64 | gliding rod |
| 65 | adjustable stopper |
| 66 | coupling unit, coupling sheet |
| 67 | movable stopper |
| 68 | spring device |
| 69 | center line |
| 70 | coupling mechanism |
| 72 | return side |
| 73 | carrying side |
| 74 | travel capturing device |
| 75 | driving unit |
| 76 | driving unit |
| 100 | packaging machine |

The invention claimed is:

1. A processing device for processing at least one stack of bags including a plurality of open-mouth bags, the processing device comprising:

at least one stacking device on which the stack of bags is arranged in a base position, wherein the open-mouth bags of the stack of bags have a bag length and an open filling mouth at one end thereof;

at least one marker device and at least one bag conveying device are provided, wherein the at least one bag conveying device is configured for gripping a topmost open-mouth bag of the stack of bags in the base position and for displacing the topmost open-mouth bag to a take-up position only partially supported on the stack of bags;

at least one pivot device disposed above the stacking device, said at least one pivot device acts on and engages the open filling mouth of the topmost open-mouth bag in the take-up position, said at least one pivot device including at least one gripper device, wherein said at least one pivot device moves between a first pivot position and a second pivot position, wherein in said first pivot position, said at least one gripper device grips the open end of the topmost open-mouth bag in the take-up position, and in said second pivot position, said at least one gripper device transfers the topmost open-mouth bag to a bag opener;

a stationary supporting device configured for supporting a portion of the topmost open-mouth bag, wherein said at least one marker device is configured for applying at least one mark on the portion of the topmost open-mouth bag that rests flat and stationary on said supporting device in the take-up position; and an appending device that appends the topmost open-mouth bag including the at least one mark, to a filling spout.

2. The processing device according to claim 1, wherein the at least one bag conveying device grips the topmost open-mouth bag by its open filling mouth.

3. The processing device according to claim 1, wherein the at least one bag conveying device comprises at least one suction device.

4. The processing device according to claim 3, wherein the suction device is extendably disposed at the at least one bag conveying device.

5. The processing device according to claim 1, wherein a distance of the take-up position from the base position is less than half the bag length.

6. The processing device according to claim 1, wherein a lifting device is provided for lifting a rear end of the topmost open-mouth bag of the stack of bags in the base position.

7. The processing device according to claim 1, further comprising at least one product feeder and at least one filling spout configured for filling the open-mouth bags.

8. The processing device according to claim 1, further comprising at least one closing device for closing the open filling mouth of the open-mouth bags.

9. The processing device according to claim 1, wherein at least one centering device is provided for centering the stack of bags and for guiding the open-mouth bags during transfer to the take-up position.

10. A method for processing at least one stack of bags having a multitude of open-mouth bags, the method comprising:

disposing the stack of bags on a stacking device in a base position wherein at least one marker device and a bag conveying device are provided;

gripping a topmost open-mouth bag of the stack of bags in the base position using the bag conveying device;

displacing the topmost open-mouth bag to a stationary, take-up position that is partially supported on a supporting device and on the stack of bags;

marking a portion of the open-mouth bags resting flat and stationary on the supporting device with at least one mark using the at least one marker device;

moving the topmost open-mouth bag between a first pivot position and a second pivot position using a pivot device having a gripper device, wherein in said first pivot position, said gripper device grips the open end of the topmost open-mouth bag in the take-up position, and in said second pivot position, said gripper device transfers the topmost open-mouth bag to a bag opener; and appending the topmost open-mouth bag including the at least one mark, to a filling spout.

* * * * *